US006997688B1

(12) United States Patent
Klein et al.

(10) Patent No.: US 6,997,688 B1
(45) Date of Patent: Feb. 14, 2006

(54) SECONDARY CONTAINMENT FOR A MAGNETIC-DRIVE CENTRIFUGAL PUMP

(75) Inventors: Manfred P. Klein, Highland Park, IL (US); Brian C. Ward, Mount Prospect, IL (US); Jeffrey S. Brown, Plainfield, IL (US); Scott A. McAloon, Lombard, IL (US); Peter E. Phelps, Darien, IL (US)

(73) Assignee: Innovative Mag-Drive, LLC, Chicago, IL (US)

( * ) Notice: Subject to any disclaimer, the term of this patent is extended or adjusted under 35 U.S.C. 154(b) by 293 days.

(21) Appl. No.: 10/383,089

(22) Filed: Mar. 6, 2003

(51) Int. Cl.
*F04B 17/00* (2006.01)

(52) U.S. Cl. ..... 417/420; 417/423.11

(58) Field of Classification Search ..... 417/420, 417/313, 423.11
See application file for complete search history.

(56) References Cited

U.S. PATENT DOCUMENTS

| | | | | | |
|---|---|---|---|---|---|
| 2,556,854 | A | * | 6/1951 | Spears et al. | 310/104 |
| 4,655,684 | A | | 4/1987 | Haentjens | 415/170 A |
| 4,722,661 | A | * | 2/1988 | Mizuno | 415/131 |
| 4,838,763 | A | | 6/1989 | Kramer et al. | 417/63 |
| 4,871,301 | A | | 10/1989 | Buse | 417/420 |
| 5,066,200 | A | * | 11/1991 | Ooka | 417/63 |
| 5,165,868 | A | | 11/1992 | Gergets et al. | 417/366 |
| 5,173,019 | A | * | 12/1992 | Sdano | 415/118 |
| 5,322,421 | A | * | 6/1994 | Hansen | 417/420 |
| 5,407,331 | A | | 4/1995 | Atsumi | 417/420 |
| 5,411,366 | A | | 5/1995 | Rockwood | 415/113 |
| 5,445,494 | A | | 8/1995 | Hanson | 415/107 |
| 5,525,039 | A | | 6/1996 | Sieghartner | 417/32 |
| 5,562,406 | A | * | 10/1996 | Ooka et al. | 415/112 |
| 5,569,024 | A | | 10/1996 | Dummersdorf et al. | 417/420 |
| 5,580,215 | A | | 12/1996 | Sidelko et al. | 415/113 |
| 5,683,229 | A | | 11/1997 | Stoll et al. | 417/366 |
| 5,944,489 | A | | 8/1999 | Vaughn et al. | 417/44.1 |
| 6,056,520 | A | * | 5/2000 | Nguyen et al. | 417/420 |

OTHER PUBLICATIONS

HMD Seal/Less Pumps Ltd., An Introduction to Secondary Control/Containment, Technical Profile, pp. 1-4 (1993).
48SC/S48SC Dry-Running Secondary Containment Seal. Specification Sheet [online]. John Crane Inc., Dec. 1997, pp. 1-4 [retrieved on Oct. 25, 2003]. Retrieved from the Internet: <URL: http://www.johncrane.co.uk/PDFs/s48sc.pdf>.
HMD/Kontro Sealless Pumps. Advertising brochure [online]. HMD Seal/less Pumps Ltd., 2000, pp. 1-2 [retrieved on Oct. 25, 2003]. Retrieved from the Internet: <URL: http://www.hmdpumps.com/Documents/Operational%20Security.pdf>.

(Continued)

*Primary Examiner*—Timothy P. Solak

(57) ABSTRACT

A centrifugal pump includes a housing having a housing cavity, an inlet, and an outlet. A pump shaft is located within the housing cavity. A radial bearing coaxially surrounds the pump shaft. The shaft and the radial bearing are rotatable with respect to one another. An impeller is positioned to receive a fluid from the inlet and to exhaust the fluid to the outlet. The impeller has a first magnet assembly. A rotor has a second magnet assembly spaced apart from the first magnet assembly. A primary container is interposed between the impeller and the rotor. The primary container is arranged to contain a pumped fluid. A drive shaft is associated with the rotor for rotating the rotor. A secondary container contains the pumped fluid if the primary container leaks. The secondary container supports a generally dry-running seal (e.g., non-lubricated seal) associated with the drive shaft. The seal is disposed axially from the primary container and has a stationary portion and a rotating portion.

26 Claims, 7 Drawing Sheets

OTHER PUBLICATIONS

Type 48LP/48MP/48HP, Low Emission Elastomer O-Ring Seals. Specification Sheet [online]. John Crane Inc., Apr. 2001, pp. 1-6 [retrieved on Oct. 25, 2003]. Retrieved from the Internet: <URL: http://www.johncrane.com/amer/english/product/JC_IncludeFile/urlincludeFile_id_1015036515278_S-48.pdf>.

Type ECS Sealol Metal Bellows Dry-Running Secondary Containment Seal. Specification Sheet [online]. John Crane Inc., Dec. 2001, pp. 1-6 [retrieved on Oct. 25, 2003]. Retrieved from the Internet: <URL: http://www.johncrane.com/amer/english/product/JC_IncludeFile/urlincludeFile_id_1015036515410_S-ECS.pdf>.

Heinz P. Bloch, P.E., Bearing Protection Devices and Equipment Reliability: Part II—What is Really Justified?, Pumps and Systems, pp. 20-24 (Oct. 2001). [retrieved on Oct. 25, 2003]. Retrieved from the Internet: <URL http://www.isomag.com/PDFS/Pump%20Zone%20Reprint.pdf>.

Type 1604/2609/3609, First Edition API 682, Type C Sealol Metal Bellow Seals. Specification sheet [online]. John Crane Inc., Jul. 2002 pp. 1-5 [retrieved on Oct. 25, 2003]. Retrieved from the Internet: <URL: http://www.johncrane.co.uk/PDFs/s1604.pdf>.

* cited by examiner

SECONDARY CONTAINMENT FOR A MAGNETIC-DRIVE CENTRIFUGAL PUMP

FIELD OF THE INVENTION

This invention relates to secondary containment for a magnetic-drive centrifugal pump.

BACKGROUND

Magnetic-drive centrifugal pumps may be used to pump fluids, such as caustic and hazardous liquids. Instead of shaft seals, a magnetic-drive pump features a pump shaft separated from a drive shaft by a containment shell. The drive shaft is arranged to rotate with one magnetic assembly, which is magnetically coupled to another magnetic assembly. The magnetic assemblies cooperate to apply torque to the pump shaft or an impeller to pump a fluid contained by the containment shell.

Although many magnetic-drive centrifugal pumps are generally reliable, the containment shell may leak or burst from the presence of one or more of the following factors: exposure to excessive heat, exposure to excessive hydraulic pressure, exposure to extreme hydraulic transients, long-term exposure to caustic or corrosive fluids, lack of proper pump maintenance, exposure to excessive particulate matter, and exceeding other operating limitations of the pump. If the pumped fluid is caustic or corrosive, the pumped fluid may erode the interior of the containment shell such that the integrity of the containment shell is degraded over time. If the pump is not properly maintained, excessive radial bearing wear may lead to rubbing or scraping mechanical contact between the impeller and the containment shell that damages the fluid containing capacity of the containment shell. Further, if particles in the pumped fluid accumulate or lodge between the containment shell and the impeller, the containment shell may become scratched, eroded or pitted; and hence, more vulnerable to chemical attack from the pumped fluid.

Leakage of the pumped fluid from an improperly maintained, misused or abused pump may be associated with health and safety risks because the pumped fluid may be hazardous, caustic, flammable, or toxic, for instance. According, even if the probability of a leak of containment shell is relatively low, a need exists for a secondary containment scheme for containing the pumped fluid in the event the containment shell leaks or bursts for any reason.

SUMMARY

A centrifugal pump includes a housing having a housing cavity, an inlet, and an outlet. A pump shaft is located within the housing cavity. A radial bearing coaxially surrounds the pump shaft. The pump shaft and the radial bearing are rotatable with respect to one another. An impeller is positioned to receive a fluid from the inlet and to exhaust the fluid to the outlet. The impeller has a first magnet assembly. A rotor has a second magnet assembly spaced apart from the first magnet assembly. A primary container is interposed between the first magnetic assembly and the second magnetic assembly. The primary container is arranged to contain a pumped fluid. A drive shaft is associated with the rotor for rotating the rotor. A secondary container contains the pumped fluid if the primary container leaks. The secondary container supports a generally dry-running seal (e.g., a non-lubricated seal) associated with the drive shaft. The seal is disposed axially apart from the primary container and has a stationary portion and a rotating portion, where the stationary portion is stationary with respect to the housing.

DETAILED DESCRIPTION

Figure 1A:
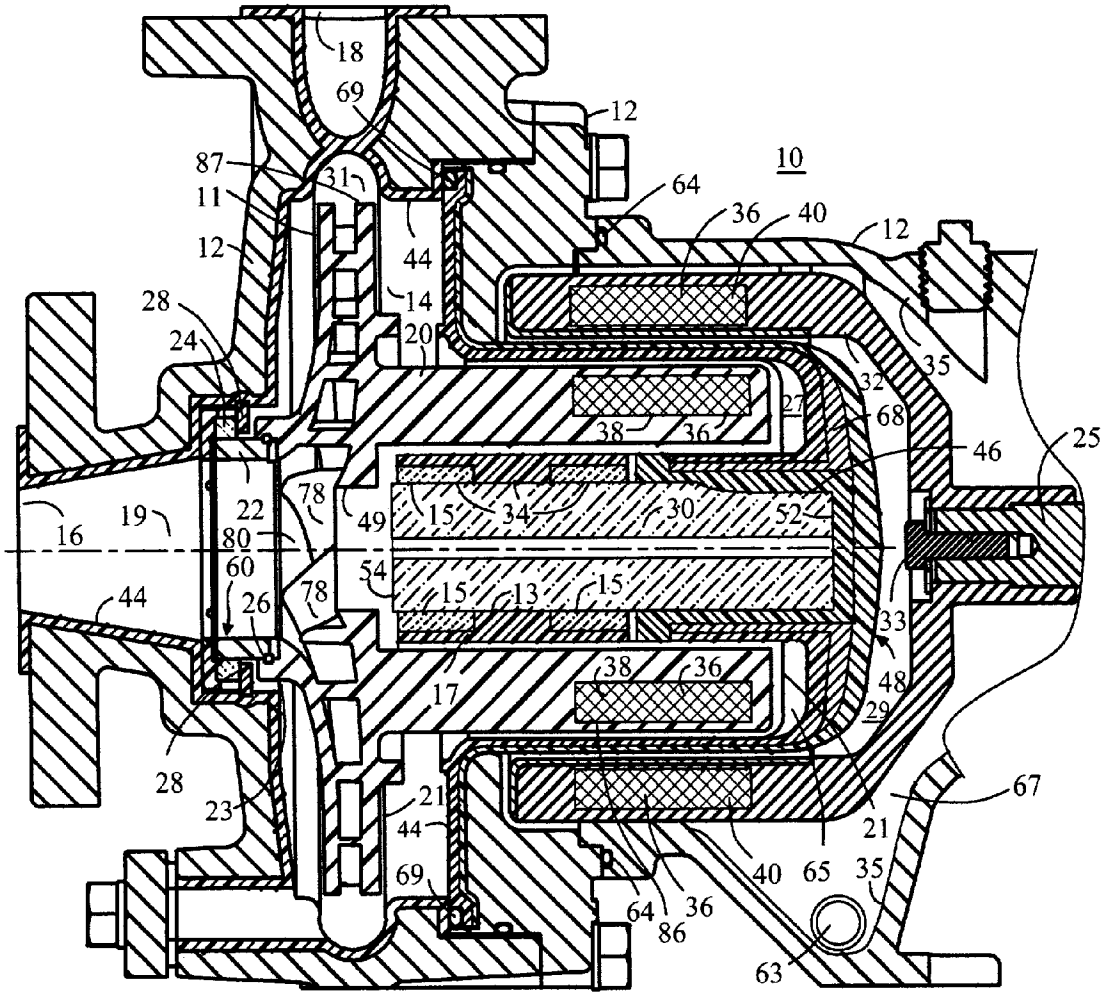
FIG. 1A and FIG. 1B are a cross section of a centrifugal magnetic-drive pump with secondary containment in accordance with one embodiment of the invention.
Figure 1B:
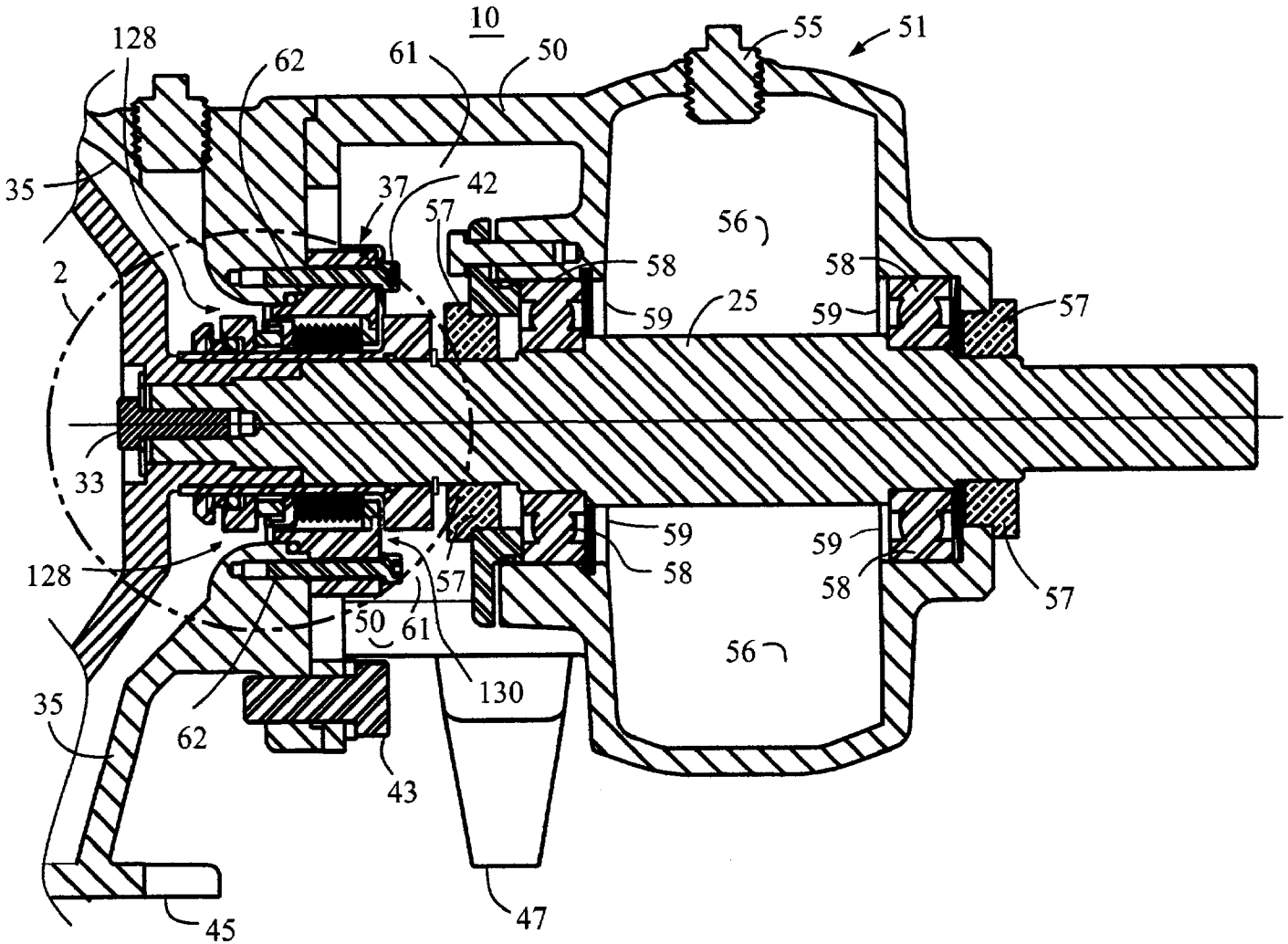

In accordance with one embodiment of the invention, FIG. 1A and FIG. 1B, together, illustrate a centrifugal pump 10. The centrifugal pump 10 includes a housing 12, a pump shaft 30, a radial bearing 34, and an impeller 20. The housing 12 has a housing cavity 14, an inlet 16, and an outlet 18. The housing 12 may be cast, molded, or otherwise formed by a group of housing sections which can be connected by fasteners, adhesives, or both. The housing cavity 14 is preferably lined with a corrosion-resistant material 44. A pump shaft 30 is located in the housing cavity 14. A radial bearing 34 coaxially surrounds the pump shaft 30. The pump shaft 30 and the radial bearing 34 are rotatable with respect to one another.

An impeller 20 is positioned to receive fluid from the inlet 16 and to exhaust fluid to the outlet 18 during rotation of the impeller 20. The impeller 20 receives the radial bearing 34.

FIG. 1A and FIG. 1B illustrate one configuration of a magnetic-drive pump 10 in which the pump shaft 30 is cantilevered. The pump shaft 30 has a first end 52 and a second end 54. In this embodiment, the first end 52 mates with a socket 46 in a primary container 48 or is otherwise mechanically supported by the primary container 48. The second end 54 is located near a hub 49 of the impeller 20. The pump shaft 30 of FIG. 1A is generally hollow or otherwise configured to reduce or eliminate the tendency of hydraulic forces to pull the pump shaft 30 out from the socket 46 in the primary container 48.

Although the pump shaft 30 is cantilevered, hollow, and stationary as shown in FIG. 1A, various other shaft configurations are possible and fall within the scope of the invention. In a first alternate configuration, the pump shaft 30 is supported at multiple points, rather than being cantilevered. In a second alternate configuration, the pump shaft 30 is solid, instead of hollow. In a third alternate configuration, the pump shaft 30 is configured to rotate with respect to the housing 12 and one or more radial bearings associated with the pump shaft 30 may be stationary. Any features of the first, second and third alternate configurations may be combined to yield a solid shaft that rotates with respect to the housing 12, for example.

The pump shaft 30 is preferably composed of a ceramic material or a ceramic composite. In an alternate embodiment, the pump shaft 30 is composed of a stainless steel alloy or another alloy with comparable or superior corrosion-resistance and structural properties. In another alternate embodiment, the pump shaft 30 comprises a metal base coated with a ceramic coating or another hard surface treatment.

The pump 10 may include one or more wear ring assemblies. A front wear ring assembly 60 may be associated with the front side 11 of an impeller 20. The front wear ring assembly 60 includes a first wear ring 22 and a second wear ring 24. The first wear ring 22 is associated with the impeller 20 and the second wear ring 24 is associated with the housing 12 of the pump 10. The second wear ring 24 may be affixed to the housing cavity 14. The first wear ring 22 may be retained by a corresponding retainer 26 and the second wear ring 24 may be retained by a respective retainer 28. The front wear ring assembly 60 defines a boundary between a suction chamber 19 and a discharge chamber 31 of the pump 10.

In one embodiment, one or more wear ring assemblies (e.g., front wear ring assembly 60) may be composed of ceramic material because ceramic materials tend to hold their tolerances over their lifetime. In addition, smaller tolerances and clearances are possible with ceramic wear rings than for many metals, alloys, polymers, plastics and other materials that are also suitable for wear rings.

In one embodiment, the radial bearing 34 comprises a bushing 15 (e.g., ceramic bushing or carbon bushing) housed in a bearing retainer 13 (e.g., a polymeric bearing retainer). For example, the bushing 15 may be composed of a ceramic material, such as silicon carbide. In an alternative embodiment, the radial bearing 34 may comprise ceramic pads or carbon pads housed in a bearing retainer 13.

In one configuration, the radial bearing 34 is mated, interlocked, press-fitted, or otherwise mechanically joined with a generally cylindrical region of the impeller hub 49 to preferably define an opening (e.g., a series of spline-like openings) between the impeller hub 49 and the exterior 17 of the radial bearing 34. The openings between the impeller hub 49 and the exterior 17 support a secondary flow path within the pump 10, which is secondary to the primary flow path between the inlet 16 and the outlet 18. In accordance with the secondary flow path, the pumped fluid first travels from the discharge chamber 31 toward a back (to the right in FIG. 1A) of the pump 10 through a radial gap between the impeller 20 and the primary container 48. Second, the fluid flows inward toward the pump shaft 30 around the back side 21 of the impeller 20. Third, the fluid flows toward a front (to the left in FIG. 1A) of the pump 10 through the opening between the impeller hub 49 and the exterior 17. Fourth, the fluid flows through the hub 49 and to the suction chamber 19. The suction chamber 19 is defined by the volume in the interior of the pump 10 around the inlet 16 and the impeller eye 80.

The impeller 20 preferably comprises a closed impeller, although in other embodiments open impellers, or partially closed impellers may be used. The impeller 20 includes a front side 11 facing the inlet 16 and a back side 21 opposite the front side 11. For a closed impeller 20 as shown in FIG. 1A, the front side 11 may be a generally annular surface that terminates in a flange 23. The back side 21 may include a generally cylindrical portion 86 and a generally annular surface 87 extending radially outward from the cylindrical portion 86. The impeller 20 includes blades 78 for propelling fluid outward from an impeller eye 80 (e.g., toward the outlet 18) during rotation of the impeller 20.

A first magnet assembly 38 is preferably associated with the impeller 20 such that the first magnet assembly 38 and the impeller 20 rotate simultaneously. The first magnet assembly 38 of magnets 36 may be integrated into the impeller 20 as shown in FIG. 1A. A second magnet assembly 40 is carried by a rotor 32. A drive motor (not shown) is capable of rotating the drive shaft 25 and the rotor 32. The second magnet assembly 40 is oriented in magnetic communication with respect to the first magnet assembly 38. The magnetic assemblies (38, 40) support magnetic coupling between each other to permit the drive shaft 25 to transmit torque to the impeller 20 through the primary container 48.

The primary container 48 is oriented between the first magnet assembly 38 and the second magnet assembly 40. The primary container 48 may be sealed to the housing 12 with an elastomeric seal 69 or otherwise to contain the pumped fluid within a wet end 27 of the pump 10 and to isolate the wet end 27 from a dry end 29 of the pump 10 during normal operation of the pump 10.

The primary container 48 is preferably made of a dielectric, at least in the region where the first magnetic assembly 38 and the second magnetic assembly 40 face one another. For example, the primary container 48 may be composed of one or more layers of a polymer, a plastic, a reinforced-polymer, a reinforced plastic, a plastic composite, a polymer composite, a ceramic, a ceramic composite, a reinforced ceramic or the like. Multiple dielectric layers may be used to add structural strength to the primary container 48 as illustrated in FIG. 1A.

Although the primary container 48 includes a metallic reinforcement 68 for structured support of the pump shaft 30, an alternate embodiment may delete the metallic reinforcement 68. Notwithstanding the foregoing composition of the primary container 48, alternate embodiments may use metallic fibers to reinforce the dielectric, a metallic containment member instead of a dielectric one, or a single layer of dielectric instead of multiple layers.

The primary container 48 is interposed between the impeller 20 and the rotor 32. The primary container 48 is arranged to contain a pumped fluid within a primary chamber 65 during normal operation of the pump 10. The primary chamber 65 is defined by the volume between the impeller 20 and the primary container 48, which generally contains fluid during normal operation or a normal operational mode of the pump 10.

The secondary container 35 is positioned generally outward from the primary container 48. The secondary container 35 supports the dry-running seal 37 and has an aperture for mounting the dry-running seal 37 therein. The dry-running seal 37 is capable of operating in a generally dry or non-lubricated state for continuous, normal operation of the pump 10. If the primary container 48 leaks, the combination of the secondary container 35 and the dry-running seal 37 is adapted to contain the pumped fluid to prevent leakage or spillage.

In one embodiment, the secondary container 35 represents a generally cylindrical vessel with an open end and an opposite end with an aperture in the opposite end for receiving the dry-running seal 37. At the open end, the secondary container 35 may have a mating flange for mating with the pump housing 12. An elastomeric seal 64 or gasket may intervene between the mating flange and the housing 12. The secondary container 35 may have bores 62 (e.g., threaded bores) for receiving fasteners (e.g., second fasteners 42) for fastening and mounting the dry-running seal 37. The secondary container 35 may have a drain plug 55 for inspecting or draining fluid out of the secondary container 35.

In one embodiment, the secondary container 35 contains a detector or sensor 63 for detecting the presence of a pumped fluid in the secondary container 35. For example, pumped fluid may be present in the secondary chamber 67 or within the secondary container 35 if the primary container 48 leaks. In one embodiment, the sensor 63 may comprise the combination of an optical source and an optical detector for detecting the presence of a pumped fluid (e.g., an opaque or translucent fluid) or a fluid level within the secondary chamber 67. In another embodiment, the sensor 63 may comprise an electrical resistance detector for detecting a differential between the electrical resistance provided by air and the electrical resistance provided by the presence of a pumped fluid (e.g., an electrically conductive pumped fluid). In another embodiment, the sensor 63 may comprise the combination of float and electrical switch, a mercury switch, or another detector for detecting the presence of the pumped fluid and providing a switch closure, a contact closure, or an electrical signal in response to the presence of pumped fluid. The sensor output of the sensor 63 may be used to drive an alarm (e.g., an audio or visual alarm) for a user or pump operator, for example. The sensor 63 supports pump maintenance that may be conveniently scheduled without disruption of pumping operations in manufacturing, industrial or commercial applications because the secondary container 35 and the dry-running seal 37 may prevent leakage until pump repair, maintenance or replacement is undertaken.

The pump 10 features a "seal-less" primary containment arrangement and a single-seal secondary containment arrangement for enhanced reliability. The "seal-less" primary containment arrangement comprises the primary container 48, which is capable of zero emissions or leakage of pumped fluid when functioning properly. Even if the primary container 48 uses an elastomeric seal 69, gasket, an elastomer, or another sealer to seal the primary container 48 to the housing 12, the primary containment arrangement may be referred to as "seal-less" in the pump industry because no shaft seal is required for pump shaft 30. The single seal secondary containment arrangement includes the combination of the dry-running seal 37 and the secondary container 35 to contain any pumped fluid that reaches the interior of the secondary container 35.

In one embodiment, a bearing frame 51 is associated with the drive shaft 25. The bearing frame 51 comprises a reservoir 56 for a lubricant, bearings 58 for supporting the drive shaft 25, and reservoir seals 57 positioned axially outward from the bearings 58 to seal the reservoir 56. A retention device 59 retains or holds the bearings 58 in proper alignment. The reservoir seals 57 keep the lubricant within the reservoir 56, while preventing or inhibiting contaminants from entering the reservoir 56 or the bearings 58 (e.g., ball bearings, roller bearings or needle bearings). The bearing frame 51 may be attached to the remainder of the pump 10 via support beams 50 that integrally extend from the bearing frame 51 to the secondary container 35 or a flange thereon. As shown in FIG. 1B, each support beam 50 is attached to the secondary container 35 via at least one first fastener 43. In one embodiment, a frame foot 47 may extend from one support beam 50 to support the pump 10 and the bearing frame 51; a housing foot 45 may extend from a bottom of the housing to support the pump 10.

The bearing frame 51 does not intervene between the primary container 48 and the dry-running seal 37. In other words, the dry-running seal 37 is preferably mounted between the bearing frame 51 and the primary container 48. Accordingly, the dry-running seal 37 and the secondary container 35 protect the reservoir 56 within the bearing frame 51 and any lubricant therein from the ingress of pumped fluid and contamination by the pumped fluid. The foregoing configuration eliminates the need to replace the lubricant within the reservoir 56 upon failure or leakage of the primary container 48 because the lubricant will not generally be contaminated by such leakage. The longevity and reliability of the bearings 58 of the bearing frame 51 is also promoted by preventing contamination of the lubricant.

A motor (not shown) or frame-mounted motor drives the drive shaft 25. For example, the motor may be connected to an end of the drive shaft 25 in FIG. 1B. The motor is protected from pumped fluid by the primary container 48 and a combination of the secondary container 35 and the dry-running seal 37. Accordingly, the windings, magnets, and any internal electrical or electronics associated with the motor are protected from the deleterious effects of the corrosive and caustic pumped fluid by a reliable dual-containment scheme of the primary container 48 and secondary container 35.

The pump 10 may include an open spatial volume 61 between the secondary container 35 and the bearing frame 51 because the secondary container 35 is connected to the bearing frame 51 by one or more support beams 50 with an open space or open volume (i.e., air) between the support beams 50. In one embodiment, the open spatial volume 61 is of sufficient dimensions to allow a human worker to introduce a tool or both a tool and a human hand (or part thereof) into the open spatial volume 61 to accomplish one or more of the following: servicing, adjusting, assembling, disassembling, inspecting or maintaining the pump 10. In one embodiment, the dry-running seal 37 has an adjustment (e.g., a tension setting for adjusting the biasing force applied to the seal faces of the dry-running seal 37). A worker or another person may readily or conveniently introduce a tool into the open spatial volume 61 to adjust the adjustment or service the seal 37 in order to optimize or otherwise enhance the performance of the dry-running seal 37, for example.

Figure 2:
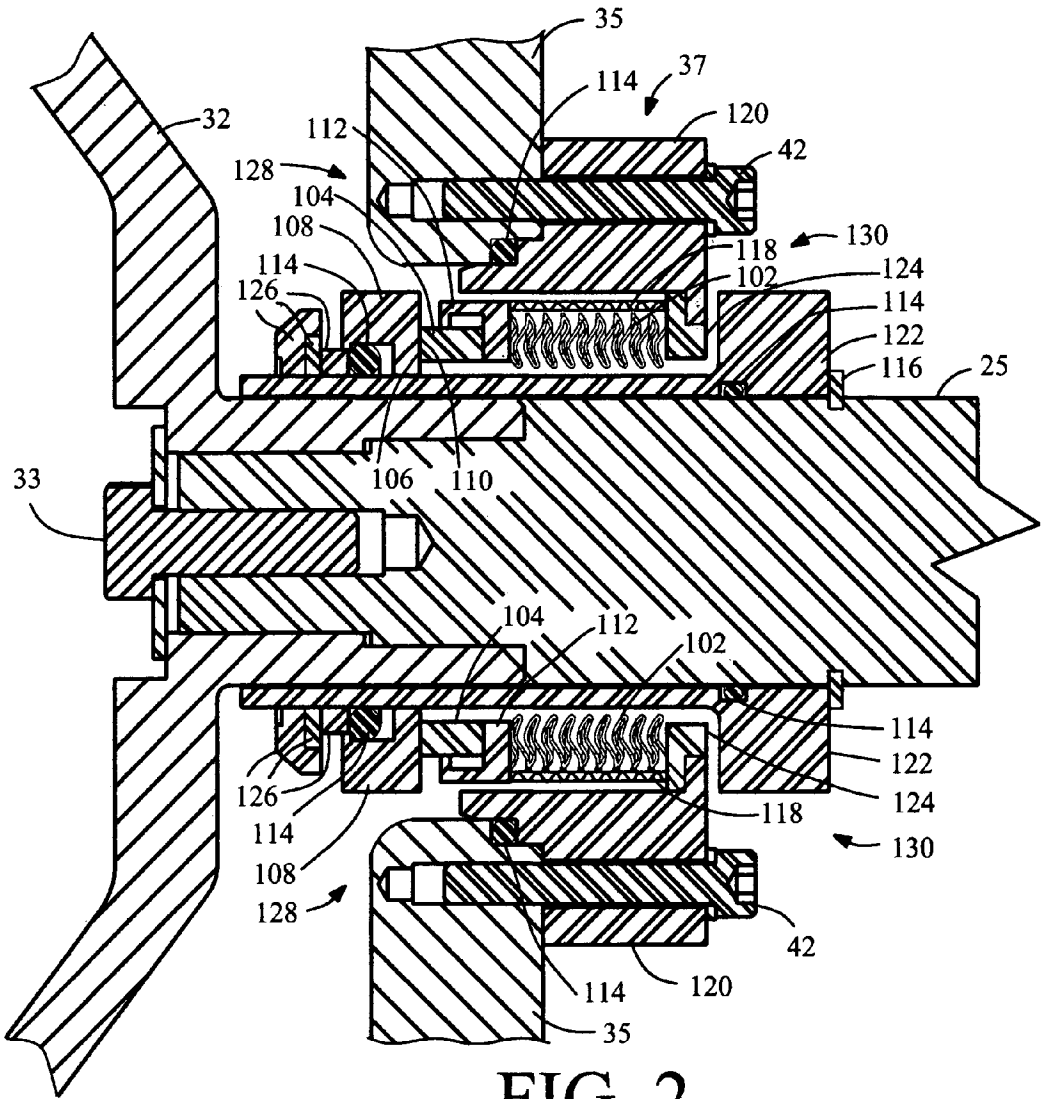
FIG. 2 is an enlarged view of one embodiment of a dry-running seal shown in the circular region 2 in FIG. 1B.

FIG. 2 shows an enlarged view of the dry-running seal 37 in the circular region 2 of FIG. 1B. Like reference numbers in FIG. 1B and FIG. 2 indicate like elements.

In general, the dry-running seal 37 comprises a seal selected from the group consisting of a non-lubricated seal, a dry-running seal, a dry-lubricated seal, and a low-friction seal. The dry-running seal 37 has a first side 128 and a second side 130. The first side 128 faces the rotor 32 and the primary container 48. The second side 130 is opposite the first side 128. The dry-running seal 37 normally operates in a dry-running or non-lubricated mode, wherein the first side 128 of the seal 37 and the second side 130 of the seal 37 are dry or exposed to air during normal operation of the pump 10. As used herein, normal operation of the pump refers to the state or condition when the primary container 48 is intact and does not leak significantly or, more typically, does not leak at all. The dry-running seal 37 is not lubricated or does not need to be lubricated by any of the pumped fluid, oil, grease, silicone, or another lubricant during a normal operational mode in which the primary container 48 does not leak.

Referring to FIG. 1A, FIG. 1B and FIG. 2, the primary container 48 and the housing cavity 14 generally define the boundaries of the primary chamber 65. The primary chamber 65 generally contains liquid or pumped fluid during normal operation of the pump 10. The first side 128 and the secondary container 35 define the boundaries of a secondary chamber 67. The first side 128 is generally exposed to air and the secondary chamber 67 is generally filled with air during a normal operational mode of the pump 10. However, the first side 128 may be wet or exposed to the pumped fluid during the failure mode or leakage mode of the pump 10 in which the primary container 48 leaks pumped fluid. Accordingly, the secondary chamber 67 contains pumped fluid during a failure mode of the pump 10 in which the primary container 48 or the primary chamber 65 leaks the pumped fluid. The combination of the secondary container 35 and the dry-running seal 37 prevents the egress of pumped fluid onto the pump exterior, if the primary container 48 leaks.

The dry-running seal 37 has a stationary portion and a rotating portion. The stationary portion is generally stationary with respect to the housing 12, whereas the rotating portion is rotatable with respect to the housing 12. The stationary portion is fastened to the secondary container 35 or otherwise secured with respect to the pump 10. The rotating portion is secured to the drive shaft 25. The stationary portion interfaces with the rotating portion at an interface, where a rotating seal face 110 meets a stationary seal face 106. The stationary seal face 106 and the rotating seal face 110 may be biased against each other to substantially inhibit or generally prevent the flow of fluid between any space between the stationary seal face 106 and the rotating seal face 110. In one embodiment, the faces (106, 110) are constructed with geometric shape, physical material or coating (e.g., polytetrafluoroethylene or another slippery polymer) that requires no lubrication.

The stationary portion comprises a housing adaptor 120 that forms an interface to the secondary container 35, the housing 12 or a mount associated with the secondary container 35 or housing 12. In one embodiment, the housing adaptor 120 is fastened to the secondary container 35 by one or more second fasteners 42 (e.g., bolts). The housing adaptor 120 may have a generally annular shape with a recess for receiving an elastomeric seal 114 to form a seal against the passage of fluid between the housing adaptor 120 and an adjoining structure of the pump 10.

A biasing member 118 has a primary end and a secondary end opposite the primary end. The primary end contacts the housing adaptor 120 or an adjoining ancillary stationary member 124. The secondary end of the biasing member 118 contacts the stationary member 104 or a holder 112 of the stationary member 104. The biasing member 118 may comprise a spring, an adjustable spring, an elastomeric member, a torsion member, an adjustable torsion member, an inert gas-charged chamber with a piston, a hydraulically charged chamber with a piston, or another suitable biasing device. The biasing member 118 may provide an axial bias or apply an axial force to the stationary seal member 104, which is generally annular. For example, the biasing member 118 may provide the axial force via holder 112 which holds the stationary seal member 104 (e.g., a replaceable stationary member).

Bellows 102 may be secured to the ancillary stationary member 124 and the holder 112, to allow axial movement of the stationary seal member 104 and tension adjustment. An adjuster (e.g., a threaded member, bolt, or screw) for adjusting the tension of the biasing member 118 may facilitate changing the biasing tension of the biasing member 118. The tension or applied axial force keeps the stationary seal face 106 and the rotating seal face 110 pressed against one another with a degree of force that prevents the flow, passage or leakage of significant fluid between the faces (106, 110), but not so great of a force to cause excessive wear and heat which would degrade seal life of the dry-running seal 37.

The rotating portion may be secured to the drive shaft 25 to rotate therewith. The rotating portion is secured to the drive shaft 25 by a retainer 116 abutting a collar 122 and an elevation of the drive shaft 25, a key, or via some other retention means. The rotating portion may include a rotating seal member 108, the collar 122, and one or more elastomeric seals 114. The rotating seal member 108 may comprise a generally annular member that is held axially captive, for example. The collar 122 slips over the drive shaft 25; one or more elastomeric seals 114 prevent leakage of fluid (a) between the drive shaft 25 and the collar 122 and (b) between the collar 122 and the rotating seal member 108. The rotating portion may include one or more spacers or ancillary rotating members 126 between the rotating seal member 108 and an end of the collar 122.

The dry-running seal 37 may provide reduced maintenance and elimination of any lubricant reservoir that a lubricated seal might otherwise require. In one embodiment, the dry-running seal 37 is capable of dry running without the need for product lubrication (i.e., lubrication by the pumped fluid) or any other lubricant, excluding any surface coating or material integrated into the seal faces themselves. Accordingly, the dry-running 37 seal requires no reservoir for holding a lubricant to lubricate the seal and requires no replacement, maintenance, or disposal of the lubricant. Further, the dry-running seal 37 may be resistant to flashing from pumped fluids that contain hydrocarbons or petroleum products.

Although other suitable materials may be used to make the dry-running seal 37, the following materials may be employed as an illustrative example. The seal faces (106, 110) may be composed of any of the following materials, alone or in combination: ceramic, silicon carbide, a metal, an alloy, a polymer, a polymeric composition, polytetrafluoroethylene, and a slippery polymer. The elastomeric seals 114 may be composed of an elastomer, a fluoroelastomer, synthetic rubber, a rubber composition (e.g., VITON, which is a trademark of E.I. Dupont De Nemours & Company Corporation), or other suitable materials. The bellows 102 may be composed of graphite cloth, flexible graphite webs, a polymer, an elastomer, a fluoroelastomer, or other suitable materials. The holder 112, collar 122, ancillary rotating members 126, ancillary stationary members 124, and the housing adaptor 120 may be composed of a metal, an alloy, a nickel alloy, a nickel-chromium alloy, a nickel-copper alloy, stainless steel, a corrosion resistant alloy (e.g., HASTELLOY, which is a trademark of Haynes International Corporation) or other suitable metallic, ceramic, or polymeric materials.

FIG. 2 shows a cross section of one embodiment of a dry-running seal 37 that may be incorporated into any of the embodiments of the magnetic-drive centrifugal pump described herein, including embodiments of FIG. 1A and FIG. 1B.

Figure 3:
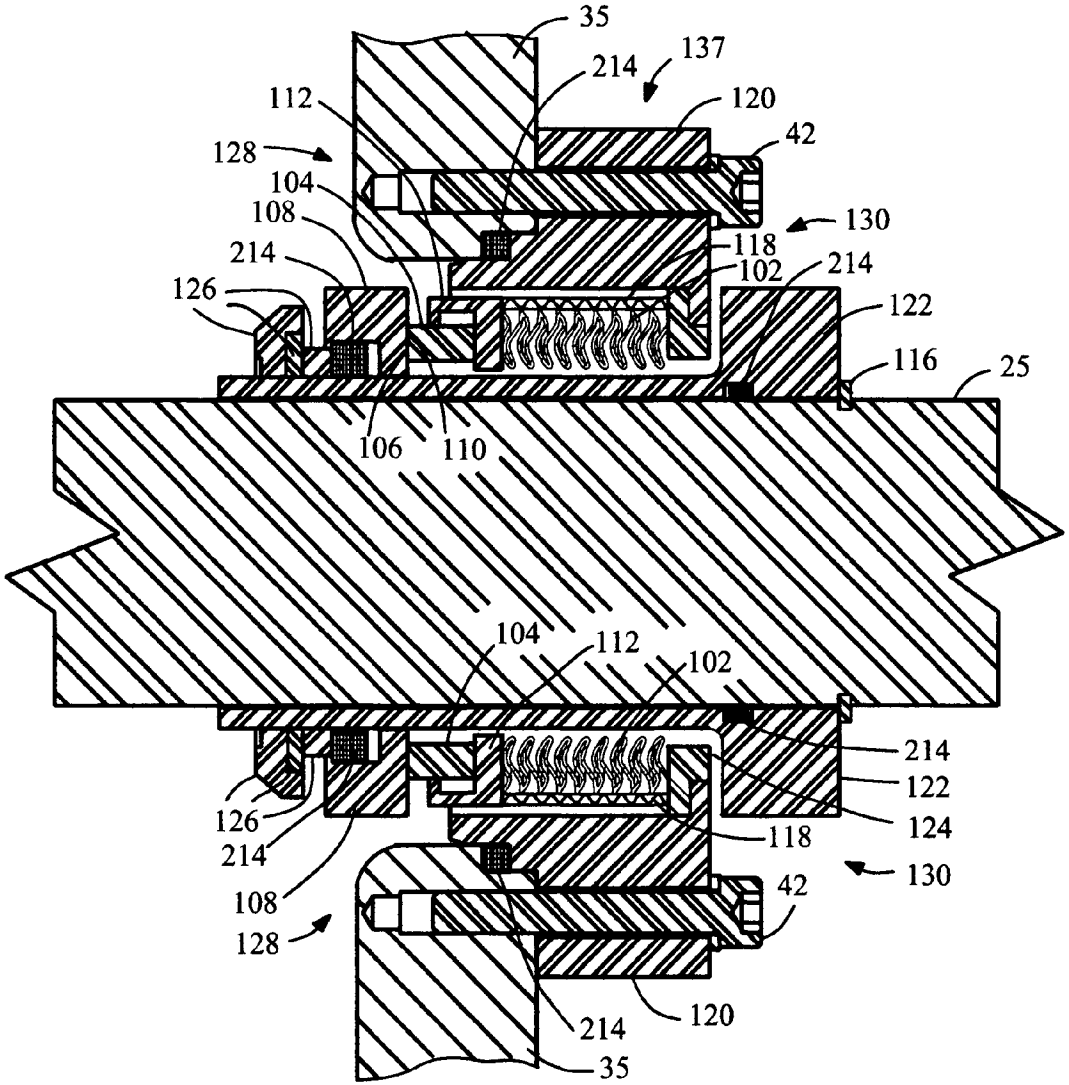
FIG. 3 shows a cross-section of an alternate embodiment of a dry-running seal that may be incorporated into a centrifugal magnetic-drive pump with secondary containment.

The dry-running seal 137 of FIG. 3 is similar to the dry-running 37 seal of FIG. 2, except the dry-running seal 137 of FIG. 3 includes a thermally tolerant seals 214 (e.g., elastomeric seals or packing rings). The thermally tolerant seals 214 may be composed of a graphite composition or a graphite material, such as GRAFOIL, which is trademark of Union Carbide Corporation, or another material that is capable of sealing during exposure to high thermal stress or high temperatures that exceed a minimum threshold (e.g., above 140 degrees Celsius). Like reference numbers in FIG. 2 and FIG. 3 indicate like elements.

The dry-running seal (37 or 137) may be installed into the pump in the following manner, among others. First, the seal (37 or 137) may be slid onto the drive shaft 25. Second, the combination of the drive shaft 25 and the bearing frame 51 is brought axially together with the remainder of the pump 10. Third, the rotor fastener 33 is tightened to connect the drive shaft 25 to the rotor 32. Fourth, the seal is slid until it seats against the rotor, a shoulder or another projection on the drive shaft 25. Fifth, the seal retainer 116 (e.g., a snap-ring) or another holding device is installed in a recess in the drive shaft 25. Sixth, the first fasteners 43 are tightened to attach the support beam 50 and the bearing frame 51 to the remainder of the pump. Seventh, the second fasteners 42 are tightened to attach the dry-running seal (37 or 137) to the pump 10. Finally, an adjustment, if present, of the seal 37 may be adjusted to a suitable or proper tension between the sealing faces.

The dry-running seal (37 or 137) may be removed from the pump 10 in the following manner, among others. Preliminarily, the rotor fastener 33 attaching the drive shaft 25 to the rotor 32 is removed. Second, the second fasteners 42 are loosened to allow the dry-running seal 37 to be removed while connected to the drive shaft 25. Third, first fasteners 43 are removed to detach a support beam 50 (e.g., a mounting plate and beam) and the bearing frame 51 from the remainder of the pump 10. Fourth, the drive shaft 25 and the bearing frame 51 are separated axially from the remainder of the pump 10. Fifth, the seal retainer 116 may be removed. Finally, the seal 37 may be slid off of the drive shaft 25.

Figure 4:
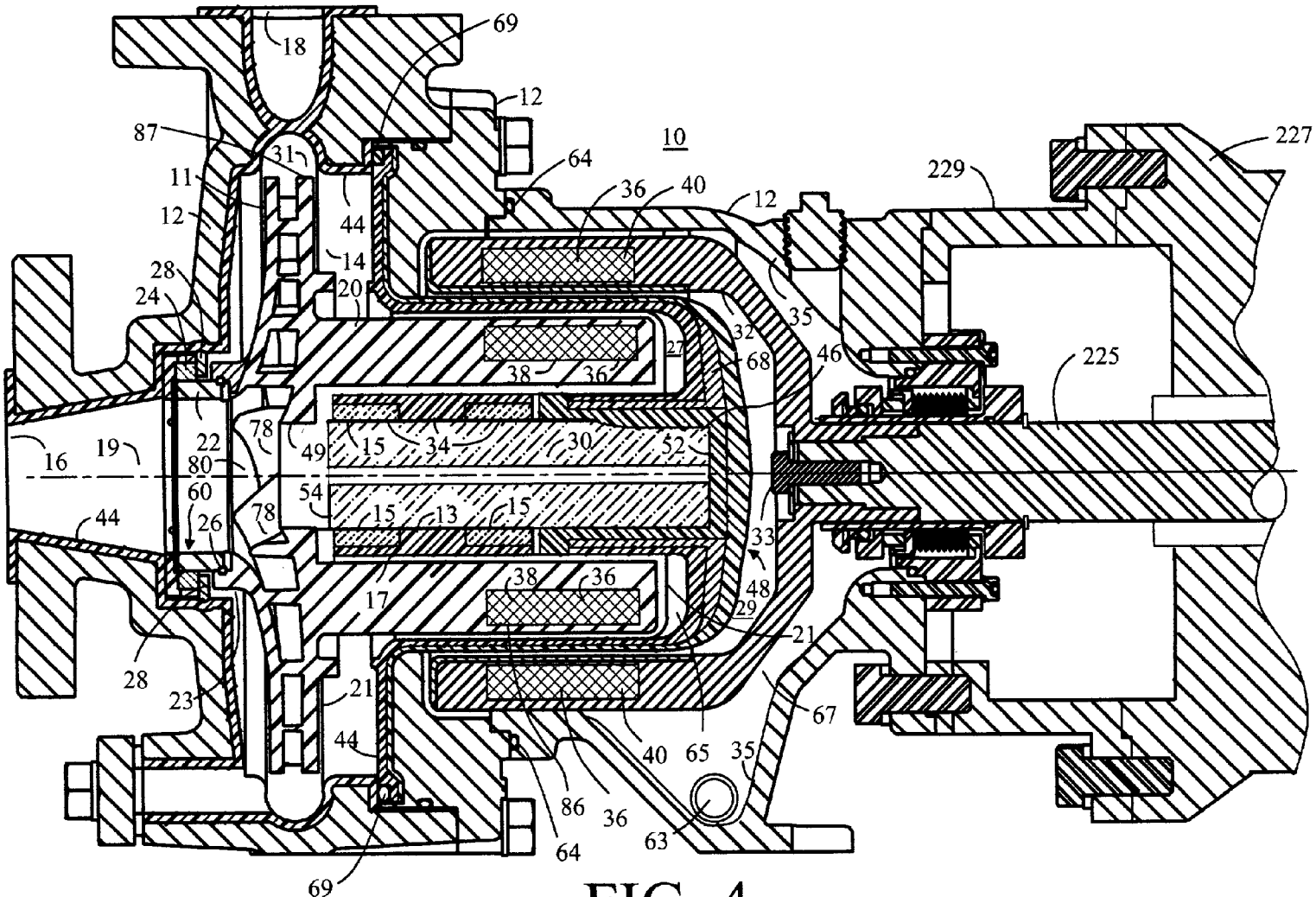
FIG. 4 is a cross section of an alternate embodiment of a centrifugal magnetic-drive pump with secondary containment.

The pump of FIG. 4 is similar to the pump of FIG. 1A and FIG. 1B, except the pump of FIG. 4 omits the bearing frame 51 of FIG. 1B. Further, an adaptor 229 is used to connect a motor casing 227 of the motor (not shown) to the secondary container 35. The adaptor 229 is connected to the secondary container 35 by one or more fasteners. In turn, the adaptor 229 is attached to the motor casing 227 by one or more fasteners. FIG. 4 represents a closely coupled configuration for a pump in which the motor itself may provide the drive shaft 225 or a mechanical connection to drive shaft 225. Like reference numbers indicate like elements in FIG. 1A, FIG. 1B, and FIG. 4.

Figure 5A:
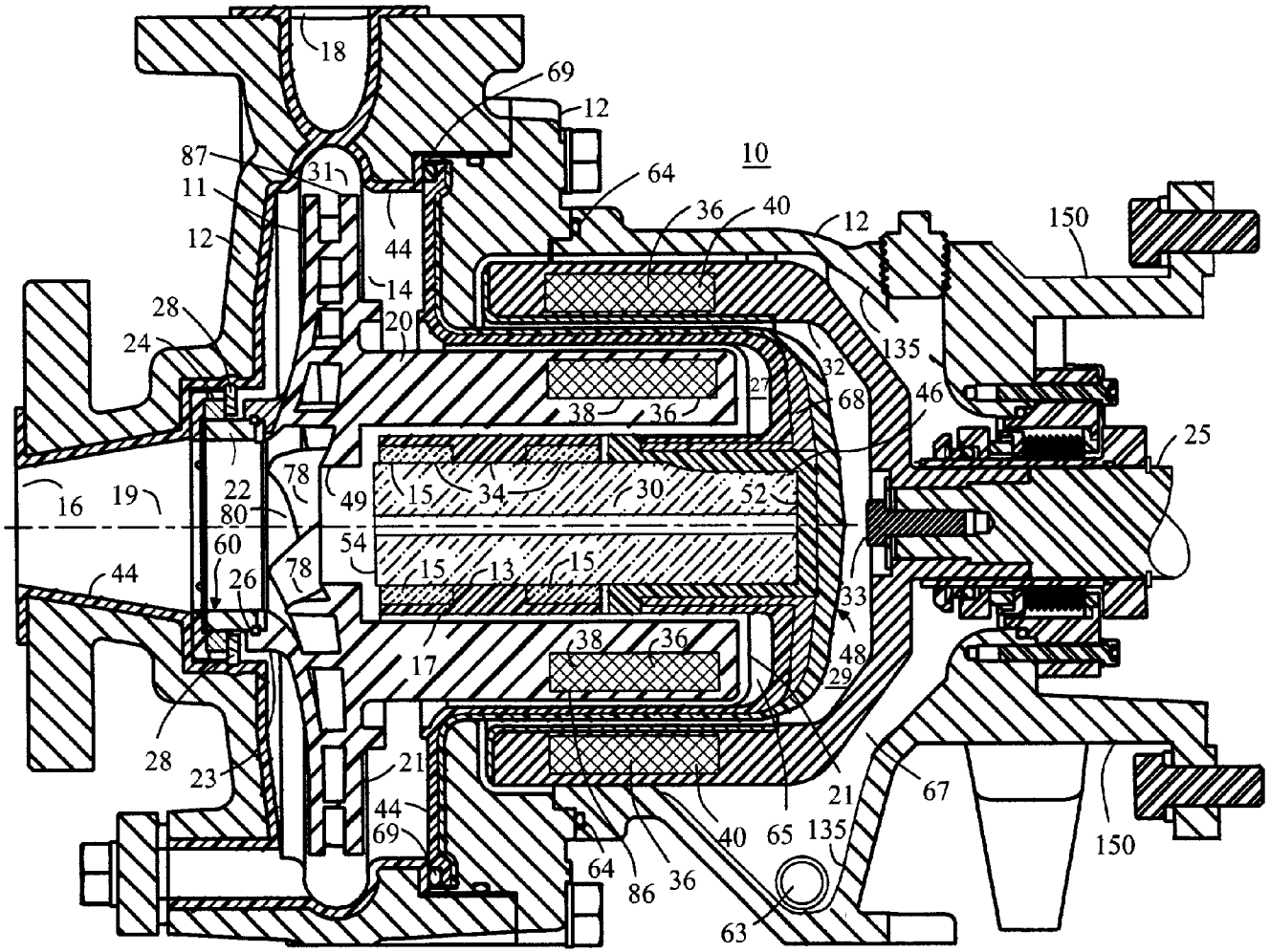
FIG. 5A and FIG. 5B are a cross section of another alternate embodiment of a centrifugal magnetic-drive pump with secondary containment.
Figure 5B:
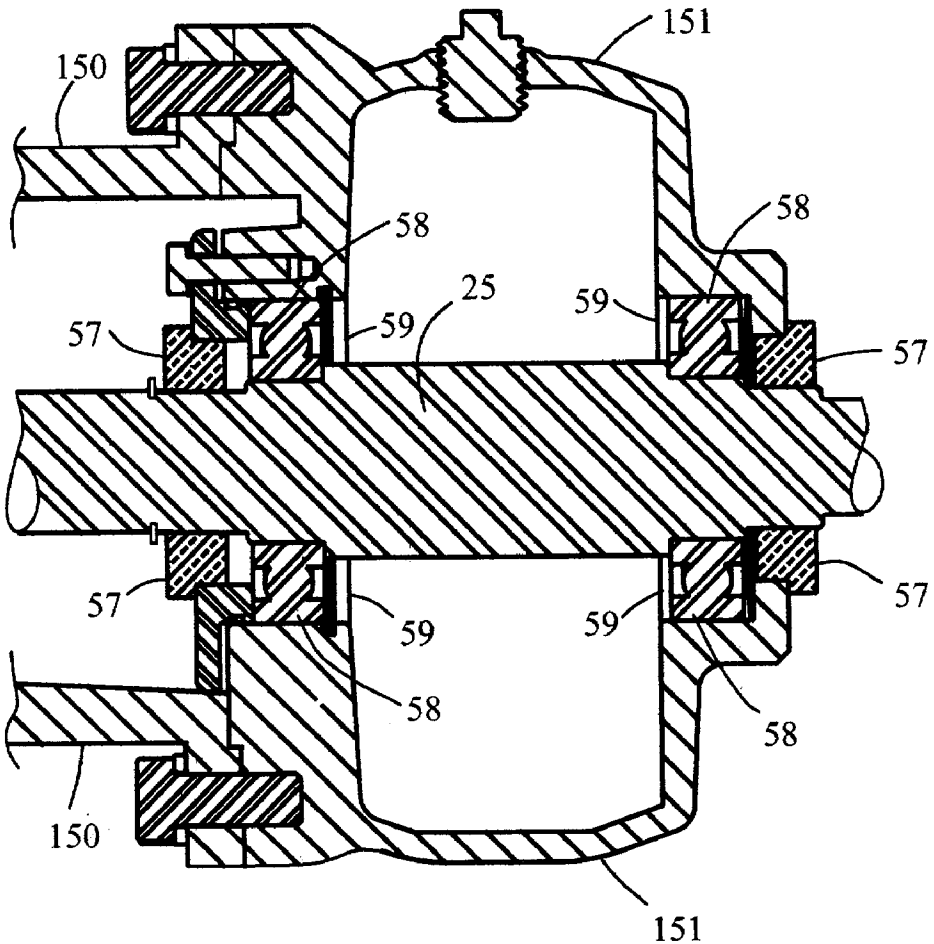

The pump of FIG. 5A and FIG. 5B is similar to the pump of FIG. 1A and FIG. 1B, except the pump of FIG. 5A and FIG. 5B has the following: (a) a modified secondary container 135 that includes an integral support member 150 integrally extending therefrom and (b) a modified bearing frame 151 that excludes the support beams 50. The pump of FIG. 5A and FIG. 5B is similar to the pump of FIG. 1A and FIG. 1B, but in the pump of FIG. 5A and FIG. 5B the integral support member 150 extends from the secondary container 135, whereas the pump of FIG. 1A and FIG. 1B includes a support beam 50 that extends from the bearing frame 51. The support member 150 is attached to the bearing frame 151 via at least one fastener. Like reference numbers in FIG. 1A, FIG. 1B, FIG. 5A and FIG. 5B indicate like elements.

The above detailed description is provided in sufficient detail to allow one of ordinary skill in the art to make and use the invention. The above detailed description describes several embodiments of the invention. The invention may have additional physical variations or additional embodiments that are encompassed within the scope of the claims. For example, the first magnetic assembly 38 may be formed of one or more magnets 36, because one magnet can be magnetized with a series of different magnetic poles (e.g., multiple north and south poles). Accordingly, any narrow description of the elements in the specification should be used for general guidance rather than to restrict the broader descriptions of the elements in the following claims.

We claim:

1. A magnetic-drive pump comprising an impeller, a rotor separated from the impeller by a primary container, a drive shaft associated with the rotor for rotating the rotor, wherein the improvement comprises:

a bearing associated with the drive shaft and receptive of a lubricant;

the primary container arranged to contain a pumped fluid within the primary container during a normal operational mode of the pump; and a secondary container for containing the pumped fluid if the primary container leaks, the secondary container supporting a dry-running seal associated with the drive shaft, the secondary container arranged to contain a pumped fluid leaking from the primary container during a failure mode of the pump, the dry-running seal spaced apart from the primary container and comprising a stationary portion and a rotating portion; the rotating portion secured to the drive shaft; the dry-running seal isolated from receiving the lubricant associated with the bearing, the secondary container and the dry-running seal arranged to isolate the bearing from contamination with the pumped fluid upon leakage of the primary container.

2. The magnetic drive pump according to claim 1 wherein the secondary container prevents the egress of pumped fluid onto a pump exterior.

3. The magnetic drive pump according to claim 1 wherein the dry-running seal has a first side facing the primary container and a second side opposite the first side, the first side and the second side being dry or exposed to air during a normal operational mode of the pump.

4. The magnetic drive pump according to claim 1 wherein the dry-running seal has a first side facing the primary container and a second side opposite the first side, the first side being wet or exposed to the pumped fluid during the failure mode of the pump.

5. The magnetic drive pump according to claim 1 wherein the dry-running seal is not lubricated by one of the pumped fluid, oil, grease, silicone, or another lubricant.

6. A centrifugal pump comprising:

a housing having a housing cavity, an inlet, and an outlet;

a pump shaft located within the housing cavity;

a radial bearing coaxially surrounding the pump shaft, the shaft and the radial bearing being rotatable with respect to one another;

an impeller positioned to receive a fluid from the inlet and to exhaust a fluid to the outlet, the impeller having a first magnet assembly;

a rotor having a second magnet assembly spaced apart from the first magnet assembly;

a primary container interposed between the impeller and the rotor, the primary container arranged to contain a pumped fluid within the primary container;

a drive shaft associated with the rotor for rotating the rotor;

a bearing associated with the drive shaft and receptive of a lubricant; and a secondary container for containing the pumped fluid if the primary container leaks; the secondary container supporting a generally dry-running seal associated with the drive shaft, the generally dry-running seal disposed axially from the primary container and comprising a stationary portion and a rotating portion; the rotating portion secured to the drive shaft; the generally dry-running seal isolated from receiving the lubricant associated with the bearing, the secondary container and the generally dry-running seal arranged to isolate the bearing from contamination with the pumped fluid upon leakage of the primary container.

7. The pump according to claim 6 wherein the primary container comprises a seal-less arrangement; the dry-running seal having no liquid lubricant at an interface of seal faces between the stationary portion and the rotating portion.

8. The pump according to claim 6 wherein the dry-running seal has at least a portion of a first side facing the rotor with the rotor intervening between the dry-running seal and the primary container; the secondary container containing at least a portion of the primary container, at least a portion of the rotor, and at least a portion of the drive shaft.

9. The centrifugal pump according to claim 6 wherein the dry-running seal has a first side and a second side, the first side facing the rotor, the second side opposite the first side, the primary container defining a boundary of a primary chamber, the first side and the secondary container forming a secondary chamber, the first side being exposed to air and the secondary chamber generally filled with air during a normal operational mode of the pump.

10. The centrifugal pump according to claim 9 wherein the secondary chamber is at least partially filled with the pumped fluid during a failure mode of the pump in which the primary container leaks the pumped fluid.

11. The centrifugal pump according to claim 6 wherein the secondary container is associated with a sensor for detecting a presence of the pumped fluid in the secondary container.

12. The centrifugal pump according to claim 6 further comprising a bearing frame associated with the drive shaft, the bearing frame comprising a reservoir for a lubricant, the bearings and an additional bearing for supporting the drive shaft, and reservoir seals positioned axially outward from the bearings to seal the reservoir.

13. The centrifugal pump according to claim 12 wherein a support beam integrally extends from the bearing frame to the secondary container, the support beam attached to the secondary container via at least one first fastener.

14. The centrifugal pump according to claim 12 wherein a support beam integrally extends from the secondary container toward the bearing frame, the support beam attached to the bearing frame via at least one fastener.

15. The centrifugal pump according to claim 6 wherein the dry-running seal normally operates in a dry-running or non-lubricated mode and wherein a first side of the seal and a second side of the seal, opposite the first side, are exposed to air during normal operation of the pump when the primary container is intact.

16. The centrifugal pump according to claim 6 wherein the drive shaft is configured to be driven by one of a closely-coupled motor and a frame-mounted motor.

17. The centrifugal pump according to claim 6 further comprising a motor for driving the drive shaft, the motor being protected from pumped fluid by the primary container and a combination of the secondary container and the dry-running seal.

18. The centrifugal pump according to claim 6 wherein a bearing frame is connected to at least one of the housing and the secondary container via support beams, the support beams defining an open spatial volume for servicing the dry-running seal.

19. The centrifugal pump according to claim 6 wherein the dry-running seal is located between the primary container and the bearing frame to protect the bearing frame from any leakage of the pumped fluid; the bearing frame containing the bearings, an additional bearing, and a reservoir for holding a lubricant for lubrication of the bearings.

20. A centrifugal pump comprising:

a housing having a housing cavity, an inlet, and an outlet;

a pump shaft located within the housing cavity;

a radial bearing coaxially surrounding the pump shaft, the shaft and the radial bearing being rotatable with respect to one another;

an impeller positioned to receive a fluid from the inlet and to exhaust a fluid to the outlet, the impeller having a first magnet assembly;

a rotor having a second magnet assembly spaced apart from the first magnet assembly;

a primary container interposed between the impeller and the rotor, the primary container arranged to contain a pumped fluid within the primary container;

a drive shaft associated with the rotor for rotating the rotor;

a bearing associated with the drive shaft and receptive of a lubricant; and a secondary container for containing the pumped fluid if the primary container leaks; the secondary container supporting a generally non-lubricated seal associated with the drive shaft, the seal disposed axially from the primary container and comprising a stationary portion and a rotating portion; the rotating portion secured to the drive shaft; the non-lubricated seal isolated from receiving the lubricant associated with the bearing, the secondary container and the non-lubricated seal arranged to isolate the bearing from contamination with the pumped fluid upon leakage of the primary container.

21. The pump according to claim 20 wherein the primary container comprises a seal-less arrangement; the non-lubricated seal having no liquid lubricant at an interface of seal faces between the stationary portion and the rotating portion.

22. The pump according to claim 20 wherein the non-lubricated seal has at least a portion of a first side facing the rotor with the rotor intervening between the non-lubricated seal and the primary container; the secondary container containing at least a portion of the primary container, at least a portion of the rotor, and at least a portion of the drive shaft.

23. The centrifugal pump according to claim 20 wherein the non-lubricated seal has a first side and a second side, the first side facing the rotor, the second side opposite the first side, the primary container defining a boundary of a primary chamber, the first side and the secondary container forming a secondary chamber, the first side being exposed to air and the secondary chamber generally filled with air during a normal operational mode of the pump.

24. The centrifugal pump according to claim 23 wherein the secondary chamber is at least partially filled with the pumped fluid during a failure mode of the pump in which the primary container leaks the pumped fluid.

25. The centrifugal pump according to claim 20 wherein the secondary container is associated with a sensor for detecting a presence of the pumped fluid in the secondary container.

26. The centrifugal pump according to claim 20 wherein the non-lubricated seal normally operates in a generally dry-running mode or non-lubricated mode and wherein a first side of the seal and a second side of the seal, opposite the first side, are exposed to air during normal operation of the pump when the primary container is intact.

* * * * *